US011311814B2

(12) United States Patent
Medwed

(10) Patent No.: US 11,311,814 B2
(45) Date of Patent: Apr. 26, 2022

(54) PLUSH STUFFED WITH MOLDED OR SCULPTED FOAM

(71) Applicant: GENNCOMM, LLC, Tarzana, CA (US)

(72) Inventor: Jeremy Brian Medwed, Woodland Hills, CA (US)

(73) Assignee: GENNCOMM LLC, Tarzana, CA (US)

( * ) Notice: Subject to any disclaimer, the term of this patent is extended or adjusted under 35 U.S.C. 154(b) by 0 days.

(21) Appl. No.: 16/823,030

(22) Filed: Mar. 18, 2020

(65) Prior Publication Data

US 2020/0215446 A1 Jul. 9, 2020

Related U.S. Application Data

(63) Continuation of application No. 16/564,118, filed on Sep. 9, 2019, now Pat. No. 10,596,475, which is a (Continued)

(51) Int. Cl.
*A63H 3/02* (2006.01)
*A63H 13/16* (2006.01)

(52) U.S. Cl.
CPC ..... *A63H 3/02* (2013.01); *A63H 13/16* (2013.01)

(58) Field of Classification Search
CPC ..... A63H 3/02; A63H 13/16
(Continued)

(56) References Cited

U.S. PATENT DOCUMENTS 2,224,456 A 12/1940 Janas
2,666,394 A 1/1954 Sadler et al.
(Continued)

FOREIGN PATENT DOCUMENTS

CA 657031 A 5/1963
CA 2601131 A1 12/2008
(Continued)

OTHER PUBLICATIONS

Shaw et al., Waffles the Memory Foam Corgi by Memory Plush, Kickstarter, published Mar. 28, 2017, https://www.kickstarter.com/projects/1081021071/waffles-the-memory-foam-corgi-by-memory-plush, last accessed Jun. 30, 2020, 7 pages.
(Continued)

*Primary Examiner* — Alexander R Niconovich
(74) *Attorney, Agent, or Firm* — Gugliotta & Gugliotta LPA

(57) ABSTRACT

A plush toy system comprises a foam inner, formed into a character shape, made with a compressible foam. A flexible outer covering surrounds the foam inner and has an inner surface for contacting the foam inner. The foam inner and the flexible outer covering combine to form a plush toy. The system may include a package having at least one open side through which the plush toy traversed when compressed to fill an interior space of the package. In use, when the plush toy is compressed and contained within the package, upon opening of the at least one open side the plush toy at least partially expands out of the at least one open side of the package. When removed completely from the package the plush toy expands to the natural size of the plush toy, preferably three times its size or more when compressed.

20 Claims, 5 Drawing Sheets

Related U.S. Application Data continuation of application No. 15/985,595, filed on May 21, 2018, now Pat. No. 10,427,061.

(60) Provisional application No. 62/508,800, filed on May 19, 2017.

(58) Field of Classification Search
USPC ..... 446/73, 75, 226, 268, 369, 385
See application file for complete search history.

(56) References Cited

U.S. PATENT DOCUMENTS 2,760,302 A * 8/1956 Cheskin ..... A63H 33/00 221/56
2,952,462 A * 9/1960 Planin ..... A63H 33/00 446/385
3,354,578 A * 11/1967 Ryan ..... B29C 67/205 156/212
4,170,086 A 10/1979 Hills
4,233,775 A 11/1980 Neufeld
4,505,687 A 3/1985 Munro
4,781,648 A 11/1988 Garfinkle
4,822,285 A 4/1989 Summerville
4,881,915 A * 11/1989 Liaw ..... A63H 13/02 446/385
4,884,991 A 12/1989 Terzian
4,936,460 A * 6/1990 Meyer ..... B65D 5/528 206/524.8
4,952,190 A 8/1990 Tarnoff et al.
5,030,271 A 7/1991 Watkins, Jr.
5,090,938 A 2/1992 Reynolds
5,178,807 A 1/1993 Thary
5,224,894 A 7/1993 Nelson et al.
5,462,473 A 10/1995 Sheller
5,496,026 A * 3/1996 Montgomery ..... A63B 43/002 473/600
5,503,584 A 4/1996 Tulling
5,613,892 A 3/1997 Barton
5,620,098 A * 4/1997 Boos ..... B65D 75/5805 206/524.8
5,649,875 A 7/1997 Spector
5,746,637 A * 5/1998 Hunt ..... A63H 33/38 446/72
5,813,896 A 9/1998 Spector
5,885,128 A 3/1999 Blaustein et al.
5,895,308 A * 4/1999 Spector ..... A63H 3/02 446/183
5,897,418 A * 4/1999 Spector ..... A63H 3/06 446/268
5,961,363 A * 10/1999 Spector ..... A63H 3/06 446/385
6,030,271 A 2/2000 Pietrafesa
6,126,510 A * 10/2000 Weiss, Jr. ..... A63H 3/02 446/431
6,155,904 A 12/2000 Spector
6,168,494 B1 1/2001 Engel
6,261,146 B1 * 7/2001 Spector ..... A63H 3/02 446/385
6,264,526 B1 7/2001 Meeker
6,494,759 B1 * 12/2002 Polick ..... A63H 13/16 446/73
6,575,807 B2 * 6/2003 Spector ..... A63H 33/00 446/385
6,672,932 B1 * 1/2004 Panec ..... A63H 3/20 446/221
6,881,119 B2 4/2005 Panec et al.
7,008,289 B2 * 3/2006 Norman ..... A63H 3/18 446/308
7,384,324 B2 6/2008 Fullmer
7,682,216 B2 * 3/2010 Spector ..... A63H 33/38 281/31
7,887,387 B2 2/2011 Colvin
9,573,070 B2 2/2017 Morley et al.
9,914,064 B2 3/2018 Daye
10,086,307 B2 * 10/2018 Duda, III ..... A63H 37/00
10,137,723 B2 * 11/2018 Bassett ..... B65B 61/20
2003/0056292 A1 3/2003 Fenichel
2006/0054020 A1 * 3/2006 Dhillon ..... A61L 9/22 96/15
2009/0093184 A1 * 4/2009 Garbos ..... A63H 33/22 19/145
2009/0156089 A1 6/2009 Hoard
2010/0112892 A1 5/2010 LaPointe
2012/0329363 A1 12/2012 Barthold
2013/0017756 A1 1/2013 Lai
2014/0097122 A1 4/2014 Patterson et al.
2014/0287649 A1 9/2014 Rebella et al.
2014/0364034 A1 * 12/2014 Lee ..... A63H 3/003 446/297
2015/0289687 A1 10/2015 Day
2015/0290546 A1 * 10/2015 Alves ..... A63H 3/02 446/369
2016/0309682 A1 10/2016 Stone
2017/0065109 A1 3/2017 Peel
2017/0290450 A1 10/2017 Jaramillo
2018/0078060 A1 3/2018 Perez
2018/0333648 A1 * 11/2018 Medwed ..... A63H 3/02
2019/0038982 A1 * 2/2019 Clark ..... A63H 3/44
2019/0209934 A1 * 7/2019 Rosenbaum ..... A63H 3/001
2019/0274285 A1 * 9/2019 Stone ..... A01K 15/026

FOREIGN PATENT DOCUMENTS

CA 2605030 A1 4/2009
EP 0206500 A1 12/1986
GB 191508118 A 1/1916
GB 2110098 A 6/1983

OTHER PUBLICATIONS

NuLine Concepts Product Catalog.
www.temupedic.com/other-products/tempur-plush-teddy-bear/v/804.

* cited by examiner

PLUSH STUFFED WITH MOLDED OR SCULPTED FOAM

RELATED APPLICATION INFORMATION

This application is a continuation of U.S. patent application Ser. No. 16/564,118, filed Sep. 9, 2019, now U.S. Pat. No. 10,596,475, which is a continuation of U.S. patent application Ser. No. 15/985,595, filed Nov. 22, 2018, now U.S. Pat. No. 10,427,061, which claims priority to Application No. 62/508,800, filed May 19, 2017, each entitled "PLUSH STUFFED WITH MOLDED OR SCULPTED FOAM," and which are expressly incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

This invention relates to plush toys, and more particularly to a compressible viscoelastic or memory-foam based plush toy.

DISCUSSION OF RELATED ART

Plush toys are well known and have been a favorite style of toy for generations. Traditional plush toys are not easily compressed, however, for the purpose of reducing their shipping and storage size, and/or to conceal their expanded shape, without damaging the plush toy and permanently deforming it. Traditional polyester fiberfill and wool are used in the prior art, but such fill for a plush toy does not enable the plush toy to be compressed without damage and expand into its original shape.

Therefore, there is a need for a system that allows a plush toy to be compressed to ⅓ of its normal, expanded size, or more, without permanently deforming the plush toy or changing its shape when expanded to its natural size. Such a needed invention could include a package that is either a different shape than the final shape of the plush toy, promoting surprise and mystery for the end user of such a system, or that resembles the shape of the plush toy but in a miniature form, or that includes a plurality of such plush toys placed into a PDQ box or tray, or in other ways. Such a needed invention would be relatively inexpensive to manufacture, transport, and store. The present invention accomplishes these objectives.

SUMMARY OF THE INVENTION

The present device is a plush toy system comprising a foam inner formed into a character shape, such as a doll or animal. The foam inner comprises a compressible foam material and has an outer surface. The foam inner, when unconstrained, expands into a natural size.

A flexible outer covering surrounds the foam inner and is, in preferred embodiments, sized in at least one dimension to be smaller than the natural size of the foam inner. In other embodiments the outer covering may be sized substantially the same as the natural size of the foam inner, or larger than the natural size of the foam inner when a loose, baggy look is desired for the plush toy. The outer cover has an inner surface for contacting the foam inner, and an outer surface. The foam inner and the flexible outer covering combine to form a plush toy.

The system may include a package having at least one open side through which the plush toy traversed when compressed to fill an interior space of the package. The package may be a rectanguloid, a two-piece ovaloid, or the like. Preferably the foam inner is stored in its compressed size at 33% or less that of its natural, expanded size when unconstrained by the package.

In use, when the plush toy is compressed and contained within the package, upon opening of the at least one open side the plush toy at least partially expands out of the at least one open side of the package. When removed completely from the package the plush toy expands to the natural size of the plush toy.

The present invention is a plush toy that can be compressed to one-third of its normal, expanded size, or more, without permanently deforming the plush toy or otherwise changing its shape when expanded to its natural size. The present system may include a package that is either a different shape than the final shape of the plush toy, promoting surprise and mystery for the end user of such a system, or that resembles the shape of the plush toy but in a miniature form, or that includes a plurality of such plush toys placed into a point-of-purchase display box or tray, or in other ways. The present invention is relatively inexpensive to manufacture, transport, and store. Other features and advantages of the present invention will become apparent from the following more detailed description, taken in conjunction with the accompanying drawings, which illustrate, by way of example, the principles of the invention.

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
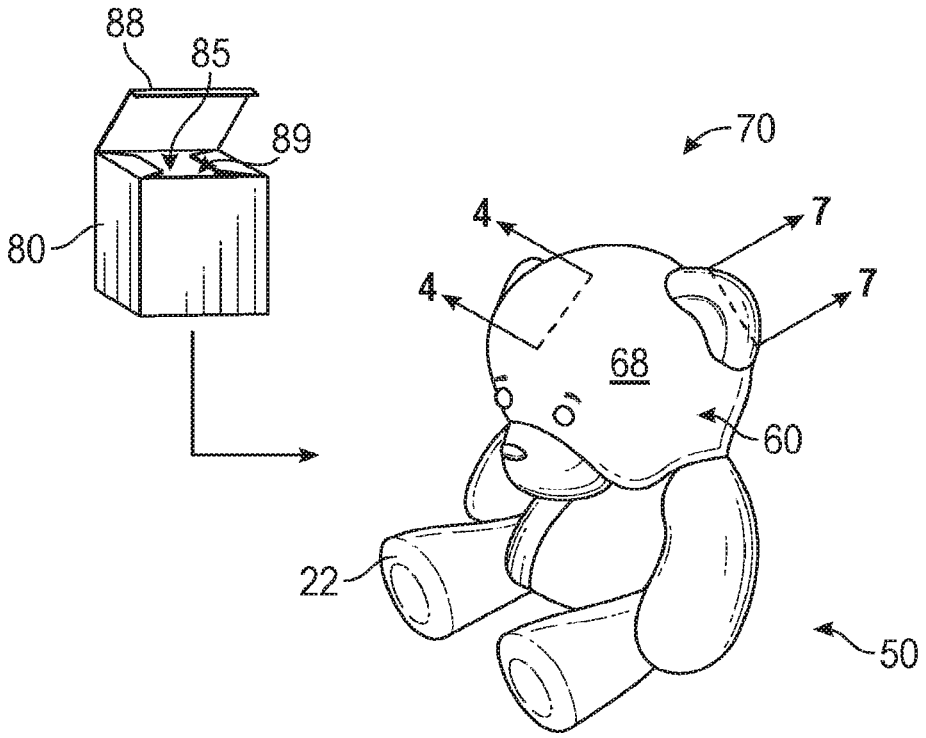
FIG. 1 is an exploded perspective view of the invention, illustrating a plush toy expanded to a natural size after being removed from a package of the invention.
Figure 2:
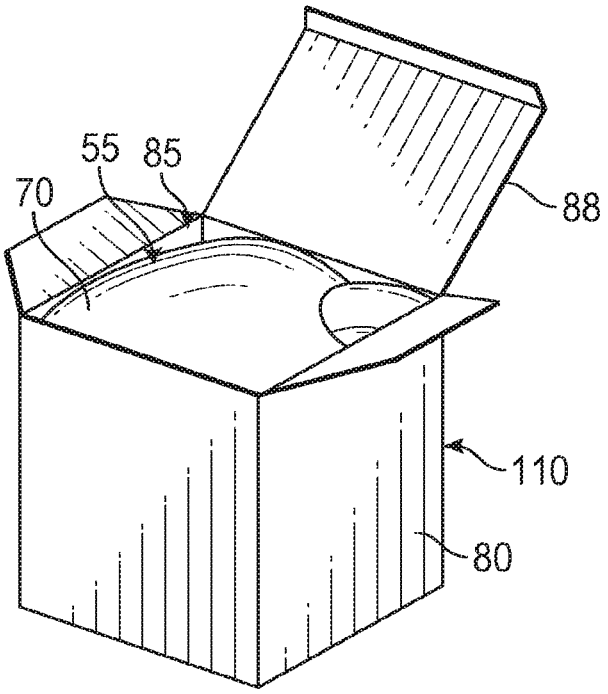
FIG. 2 is a perspective view of the invention, illustrating the plush toy as contained in the package just as the package is opened.
Figure 3:
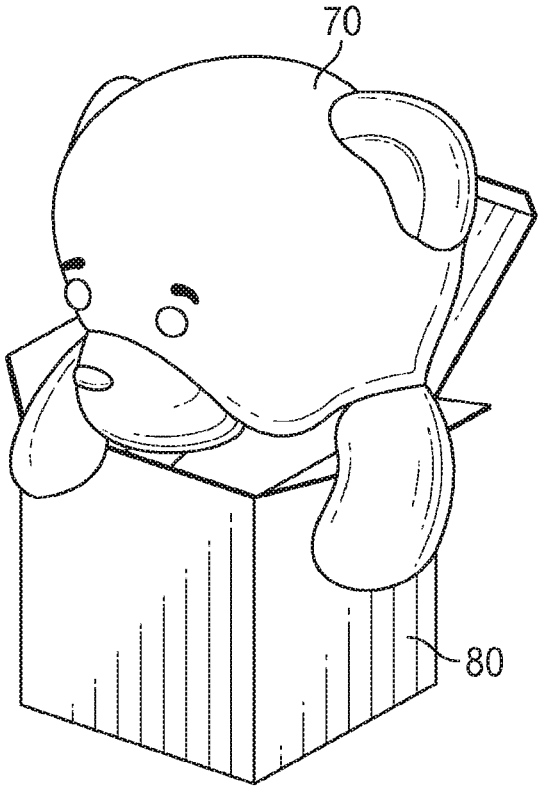
FIG. 3 is a perspective view of the invention, illustrating the plush toy expanding out of the package after the package is opened.

FIGS. 1-3 illustrate a plush toy system comprising a foam inner 20 formed into a character shape 30, such as a doll, animal, or other character shape. The foam inner 20 comprises a compressible, preferably either an open or closed-cell viscoelastic foam material 40 and has an outer surface 28. The foam inner 20, when unconstrained, expands into a natural size 50. The foam inner 20 may comprise a polyurethane or latex viscoelastic foam material, or other foam material that expands from a compressed state, preferably to three times or more of its compressed size 55. Such a foam inner 20 may be made with an injection molding process, or by cutting and shaping a foam block into the character shape 30.

Figure 5A:
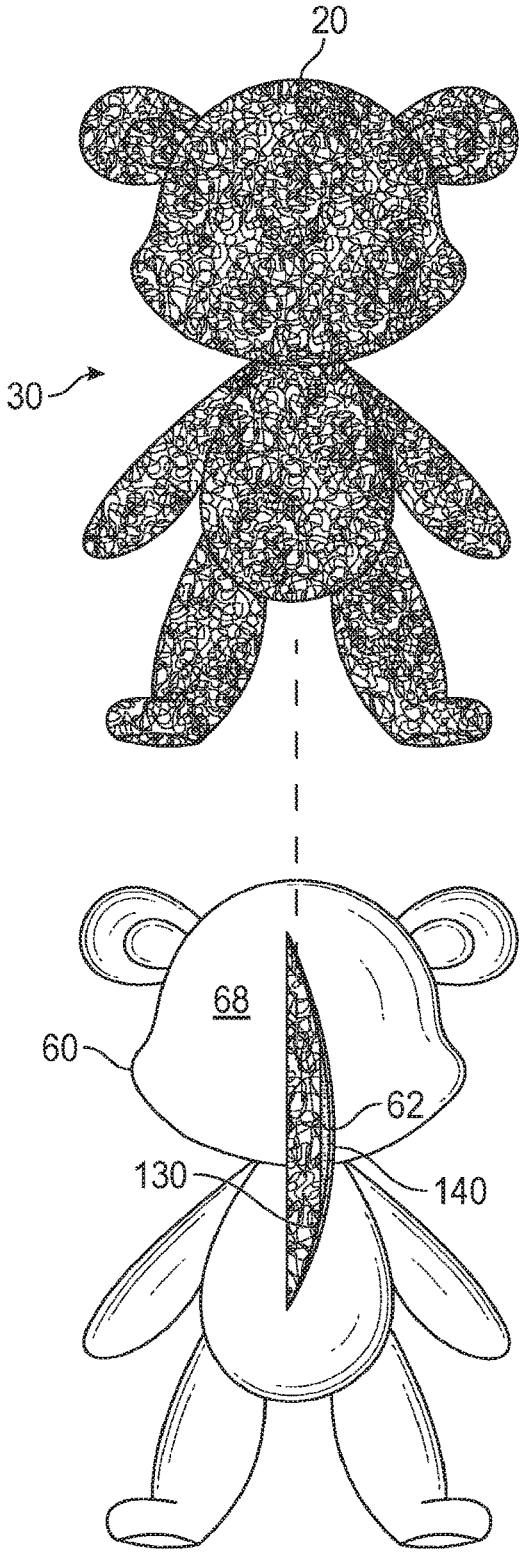
FIG. 5A is a front exploded elevational view of the foam inner, fully expanded to its natural size, and a flexible outer covering into which the foam inner is inserted.

A flexible outer covering 60 surrounds the foam inner 20 and is sized in at least one dimension to be smaller than the natural size 50 of the foam inner 20. In some embodiments the outer covering 60 may be sized substantially the same as the natural size 50 of the foam inner 20 (FIG. 5A), or larger than the natural size of the foam inner 20 when a loose, baggy look is desired for the plush toy 70. The outer cover 60 has an inner surface 62 for contacting the foam inner 20, and an outer surface 68. The foam inner 20 and the flexible outer covering 60 combine to form a plush toy 70. The covering 60 may include a flap 130 through which the foam inner 20 may be inserted during manufacturing of the plush toy 70. A closure 140, such as a zipper, hook-and-loop type fastener, mechanical snaps, or the like may be employed to close the flap 130 to seal the foam inner 20 inside the outer covering 60.

Figure 4:
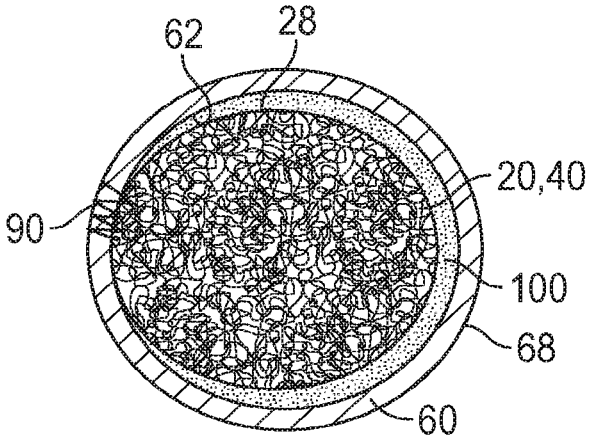
FIG. 4 is a cross-sectional view of the plush toy taken generally along line 4-4 of FIG. 1, illustrating a foam inner with an outer covering.

In preferred embodiments, at least a portion of the inner surface 62 of the outer covering 60 is fixed with the outer surface 28 of the foam inner 20 with stitching 90, adhesive 100 (FIG. 4), ultrasonic welding (not shown), or the like. Preferably the outer covering 60 is made with either a 2-way stretch material or 4-way stretch material, such as Rayon or Lycra, or other suitable web material such as woven or non-woven fabric, vinyl sheet material, or the like.

The system preferably includes a package 80 having at least one open side 85 through which the plush toy 70 traverses when compressed to fill an interior space 89 of the package 80. The package 80 may be a rectanguloid 110 (FIGS. 1-3), including a cube-shaped package 80. The package 80 may also take the form of a two-piece ovaloid 120 (FIGS. 6A-6D), wherein the at least one open side 85 is exposed when separating the two pieces thereof. Such an ovaloid 120 may include a sphere-shaped package 80. At least one package closure 88, such as a paper flap, may be included for selectively sealing the at least one open side 85. In such embodiments, the end consumer of the system may not know the character shape 30 of the plush toy 70 when opened, and as such an air of mystery is established with such a system. Alternately, the package 80 may take the form of a miniature version of the character shape 30 so as to provide an idea of the final shape of the plush toy 70 when its opened. Such a package 80 may be made of paper card stock, plastic, vinyl, glass, wood, acrylic, or the any other suitable material for a substantially rigid or resilient package 80.

In use, when the plush toy 70 is compressed and contained within the package 80, upon opening of the at least one open side 85 the plush toy 70 at least partially expands out of the at least one open side 85 of the package 80. When removed completely from the package 80 the plush toy 70 expands to the natural size 50 of the plush toy 70.

Figure 7:
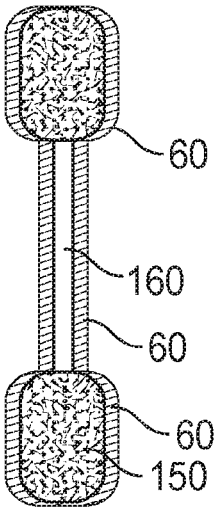
FIG. 7 is a cross-sectional view of an appendage of the plush toy having traditional fiberfill stuffing and/or no stuffing.
Figure 5B:
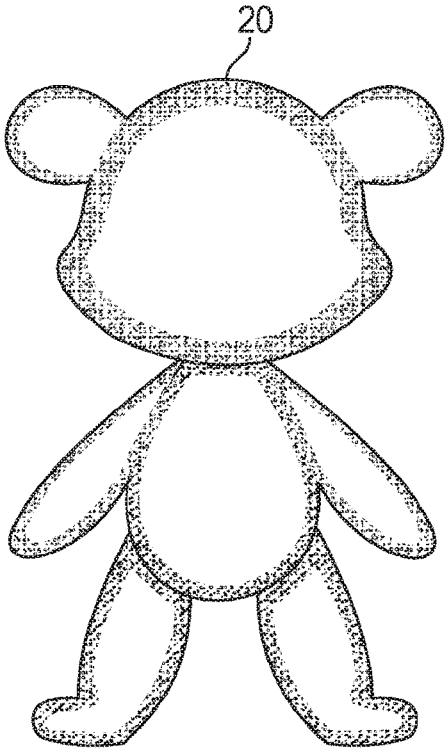
FIG. 5B is a cross-sectional view of a rear half of an alternate embodiment of the foam inner, illustrated with central hollow portions.
Figure 5C:
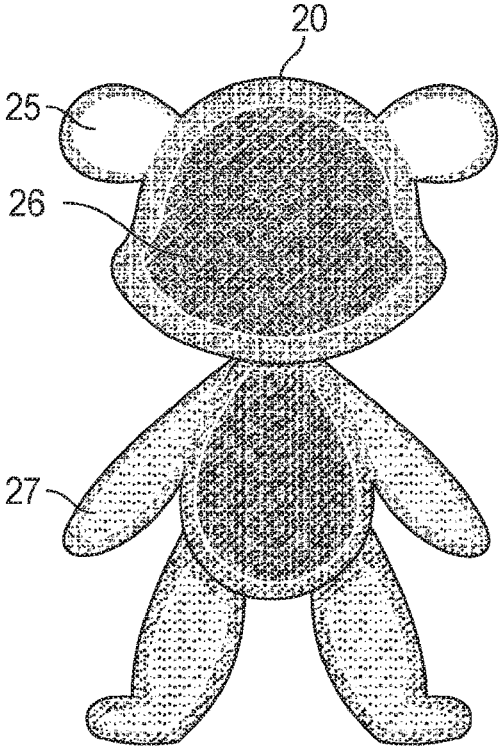
FIG. 5C is a cross-sectional view of a rear half of another alternate embodiment of the foam inner, illustrated with central hollow portions.
Figure 6A:
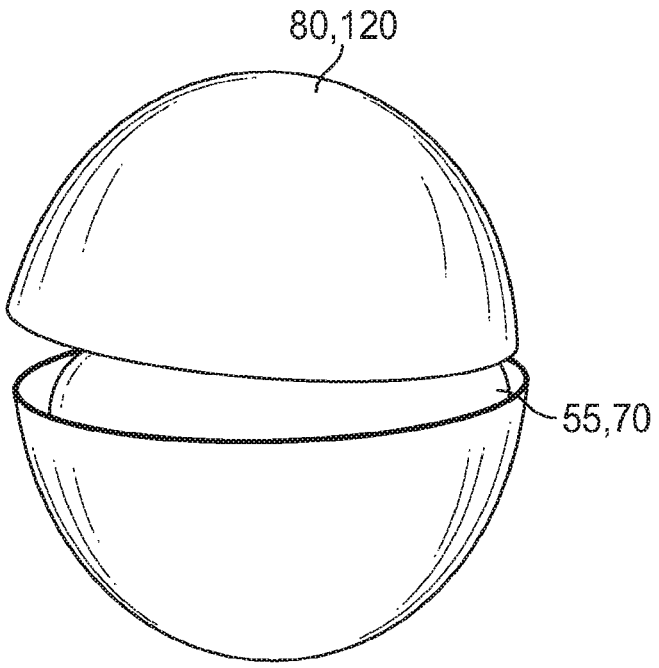
FIG. 6A is a perspective view of an alternate package of the invention, illustrated in a partially open position.
Figure 6B:
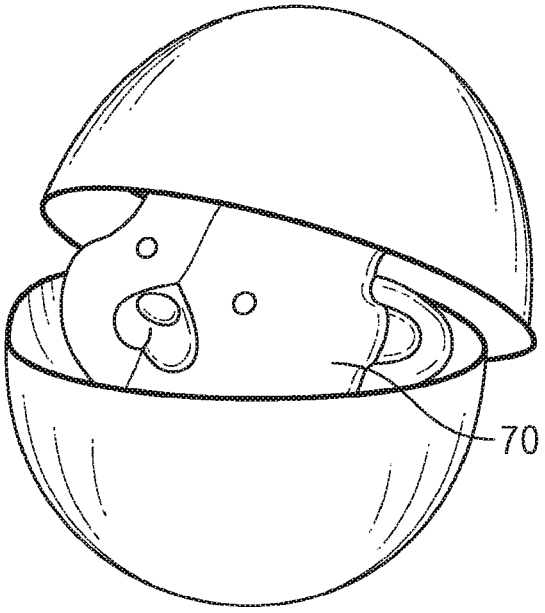
FIG. 6B is a perspective view of the embodiment of FIG. 6A, shown slightly more open and with the plush toy starting to expand towards its natural size.
Figure 6C:
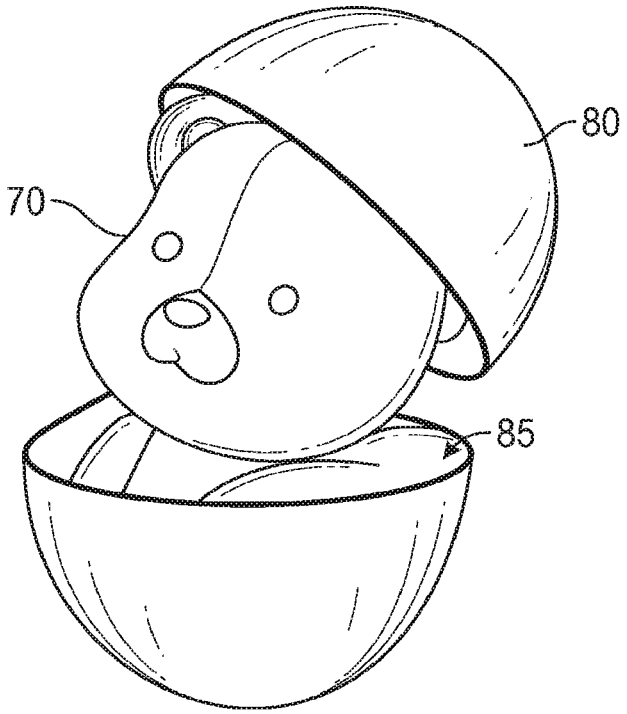
FIG. 6C is a perspective view of the embodiment of FIG. 6B, shown even more open and with the plush toy continuing to expand towards its natural size.
Figure 6D:
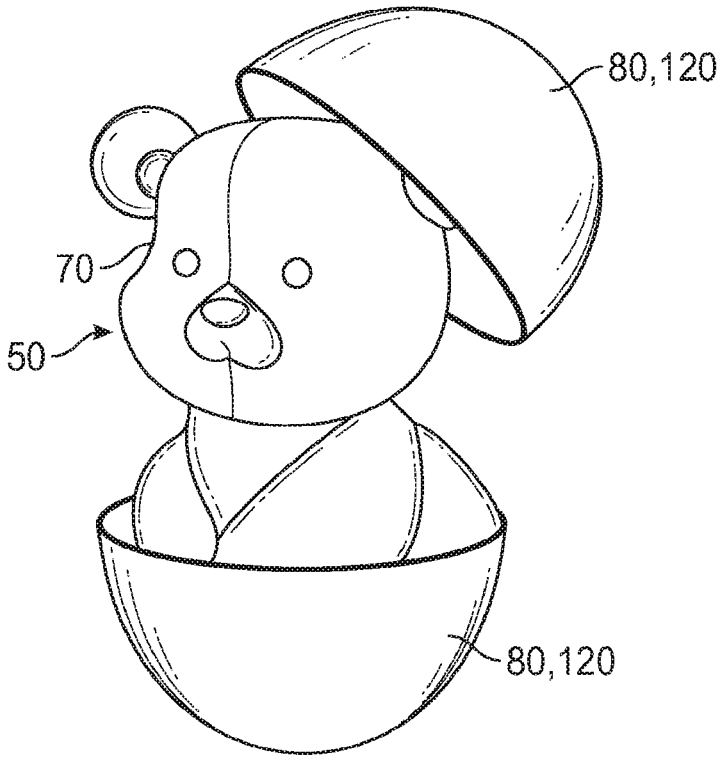
FIG. 6D is a perspective view of the embodiment of FIG. 6C, shown more fully open and with the plush toy continuing to expand towards its natural size.

In some embodiments, the foam inner 20 includes one or more appendages 22 or other sections having within a stuffing 150 (FIG. 7) taken from the group consisting of: synthetic stuffing, natural stuffing, compressible foam, wool, polyester fiberfill, feathers, beads. Such appendages 22 are not necessarily as compressible as the rest of the foam inner 20, and as such may take on different characteristics such as a different compression sound that results by compressing such an appendage 22, or a different weight or rigidity than the foam inner 20. Alternately, appendages 22 or other hollow portions 25 could be made that include no fill 160 (FIGS. 5B, 5C and 7), such as an ear of a character that remains relatively flat. Alternately appendages 22 could be made with foam material 40 having different expansion rates, or a mix of foam material 40 to get differing effects upon release of the plush toy 70 from its compressed size 55.

For example, in some embodiments, the foam inner 20 is comprised of at least two type of compressible foam material 40 that have different natural expansion rates, such that portions 26 (FIG. 5C) of the foam inner 20 with a quicker expansion rate reach their natural size 50 more quickly than other portions 27 with a foam material 40 having a slower expansion rate. As such, based on the size of the various appendages 22 and foam material 40 used therewith, the foam inner 20 may be designed such that all portions of the character shape 30 achieve their natural size 50 at roughly the same time when released from their compressed size 55.

For example, the body portion 26 of the character shape 30 may include a more quickly-expanding foam material 40 than arm or leg portions 27.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

It is claimed:

1. A plush toy comprising:

a foam inner formed of a compressible viscoelastic foam material having an outer surface, the foam inner having a natural size when unconstrained; and a shape defining textile fabric outer covering entirely surrounding the foam wherein the foam inner is compressed and constrained by the textile fabric outer covering such that the inner foam does not achieve a natural, uncompressed size or shape.

2. The plush toy of claim 1, wherein the foam inner is comprised of at least one of an open-cell or a closed-cell viscoelastic foam material.

3. The plush toy of claim 1, wherein the outer covering defines at least one appendage.

4. The plush toy of claim 3, wherein the foam inner includes a contiguous appendage matching the appendage of the outer covering such that the contiguous appendage corresponds to a placement and a size of the appendage of the outer covering.

5. The plush toy of claim 4, wherein the outer covering forms a character shape, wherein the outer covering also has a character face including the least one of a mouth and eyes.

6. The plush toy of claim 5, wherein the character shape is an animal and the outer covering defines four appendages corresponding to four legs of the animal, and the foam inner includes four contiguous appendages corresponding to the four appendages of the outer covering.

7. The plush toy of claim 1, further comprising a stuffing separate from the foam inner within the at least one appendage of the outer covering.

8. The plush toy of claim 7, wherein the stuffing is taken from the group consisting of: synthetic stuffing, natural stuffing, compressible foam, wool, polyester, fiberfill, feathers, and beads.

9. The plush toy of claim 1, wherein at least a portion of an inner surface of the outer covering is fixed with the outer surface of the foam inner.

10. The plush toy of claim 1, including a second inner material disposed within the outer covering, wherein the compressible viscoelastic foam material and the second inner material have different natural expansion rates.

11. A plush toy comprising:

an inner form molded of compressible viscoelastic foam having an outer surface defining a natural expanded state and a first shape when unconstrained, the inner form being convertible from a compressed state to the expanded state; and a flexible outer covering that closely fits around an entirety of the outer surface of the inner form and has a second shape aligned with the first shape of the inner form, wherein the second shape is a character with appendages, the plush toy consists of a combination of the outer covering and the inner form expanded within the outer covering toward, but not fully achieving its natural, expanded state, wherein an inner surface of the outer covering is configured to contact and conform to the outer surface.

12. The plush toy of claim 11, wherein the inner form is comprised of at least one of an open-cell and a closed-cell viscoelastic foam material.

13. The plush toy of claim 11, wherein the foam inner includes contiguous appendages matching the appendages of the outer covering such that the contiguous appendages correspond to placements and sizes of the appendages of the outer covering.

14. The plush toy of claim 13, wherein the second shape is a character shape, wherein the outer covering also has a character face including at least one of a mouth and eyes.

15. The plush toy of claim 13, wherein the second shape is an animal and the outer covering defines four appendages corresponding to four legs of the animal, and the foam inner includes four contiguous appendages corresponding to the four appendages of the outer covering.

16. The plush toy of claim 15, further comprising a stuffing separate from the inner form within a first appendage of the four appendages of the outer covering.

17. The plush toy of claim 16, wherein the stuffing is taken from the group consisting of: synthetic stuffing, natural stuffing, compressible foam, wool, polyester fiberfill, feathers, and beads.

18. The plush toy of claim 11, wherein at least a portion of an inner surface of the outer covering is fixed with the outer surface of the inner form.

19. The plush toy of claim 11, including a second inner material disposed within the outer covering, wherein the compressible viscoelastic foam material and the second inner material have different natural expansion rates.

20. The plush toy of claim 11, further including a package having at least one open side through which the plush toy traverses when compressed to substantially fill an interior space of the package, whereby when the plush toy is compressed and contained within the package, upon opening of the at least one open side, the plush toy expands out of the at least one open side of the package, and when removed completely from the package the plush toy expands to the second shape defined by the outer covering.

* * * * *